US006623407B2

(12) United States Patent
Novak et al.

(10) Patent No.: US 6,623,407 B2
(45) Date of Patent: Sep. 23, 2003

(54) ENERGY ABSORBING SYSTEM FOR EXERCISE EQUIPMENT

(76) Inventors: Pat J. Novak, 3026 River Oaks Dr., NE., North Liberty, IA (US) 52317; Mark A. Krull, P.O. Box 57, Greencastle, IN (US) 46135

( * ) Notice: Subject to any disclaimer, the term of this patent is extended or adjusted under 35 U.S.C. 154(b) by 197 days.

(21) Appl. No.: 09/754,030

(22) Filed: Jan. 3, 2001

(65) Prior Publication Data

US 2001/0024998 A1 Sep. 27, 2001

Related U.S. Application Data

(63) Continuation-in-part of application No. 09/240,076, filed on Jan. 29, 1999, now Pat. No. 6,174,268.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 6,174,267 B1 * 1/2001 Dalebout et al. ..... 482/54

* cited by examiner

*Primary Examiner*—Glenn E. Richman

(57) ABSTRACT

An exercise device has a variable amount of energy absorbing material disposed in series between a body supporting member and an underlying floor surface.

8 Claims, 9 Drawing Sheets

Fig. 9a
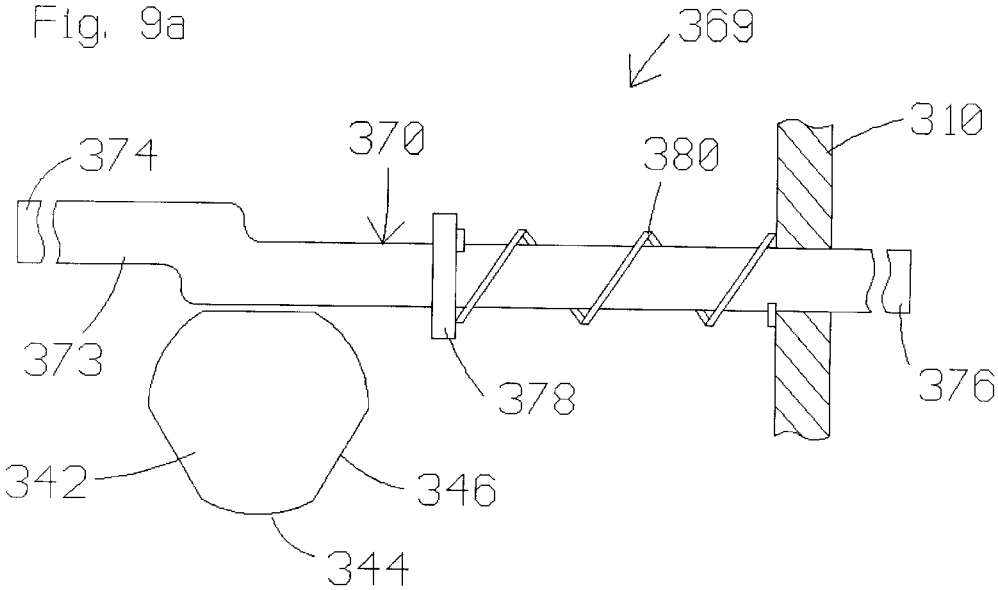
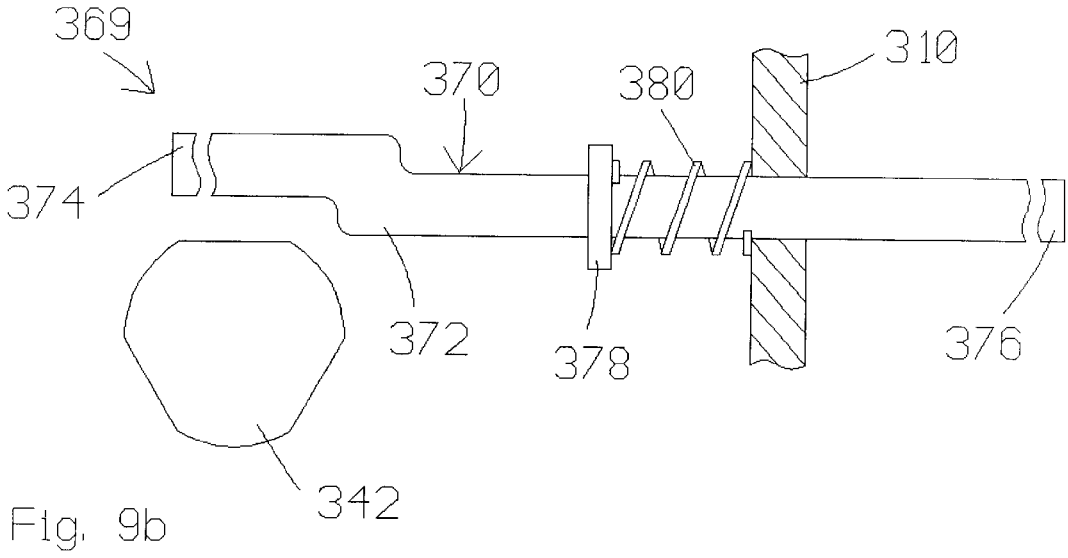
Fig. 9b 400
454
450
454
425
420
415
416
417
410

400
452
450
452
420
415
416
417
410

400
450
420
415
416
417
410

400
450
420
415
416
417
410

400
450
420
415
416
417
410

ENERGY ABSORBING SYSTEM FOR EXERCISE EQUIPMENT

CROSS-REFERENCE TO RELATED APPLICATION

This is a continuation-in-part of U.S. patent application Ser. No. 09/240,076, filed on Jan. 29, 1999 now U.S. Pat. No. 6,174,268.

FIELD OF THE INVENTION

The present invention relates to exercise equipment, and more specifically, to methods and apparatus for absorbing energy associated with exercise movement.

BACKGROUND OF THE INVENTION

One of many factors to be considered in the design of exercise equipment is energy absorption. On treadmills, for example, impact is created each time a person's foot lands on the tread and/or deck. In the absence of an energy absorption system, the impact rebounds into the person's foot and may injure the person's joints. In recognition of this potential problem with treadmills, equipment designers have developed systems to absorb or dissipate the impact so that it does not rebound into the exerciser's feet and legs. Examples of such systems are disclosed in U.S. Pat. No. 4,350,336 to Hanford and U.S. Pat. No. 5,382,207 to Skowronski et al., for example. Despite many such advances in the art, room for improvement remains.

SUMMARY OF THE INVENTION

The present invention provides an improved energy absorbing system for exercise equipment. On a preferred embodiment, the system involves disposition of a variable amount of energy absorbing material in series between a treadmill deck and an underlying floor surface. Many features and/or advantages of the present invention will become apparent from the detailed description which follows.

BRIEF DESCRIPTION OF THE DRAWING

With reference to the Figures of the Drawing, wherein like numerals represent like parts and assemblies throughout the several views.

FIG. 9*a* is a diagrammatic side view of an adjustment assembly suitable for use on the treadmill of FIG. 6;

FIG. 9*b* is a diagrammatic side view of the adjustment assembly of FIG. 9*a* in a second configuration;

DETAILED DESCRIPTION OF THE PREFERRED EMBODIMENT

Figure 1:
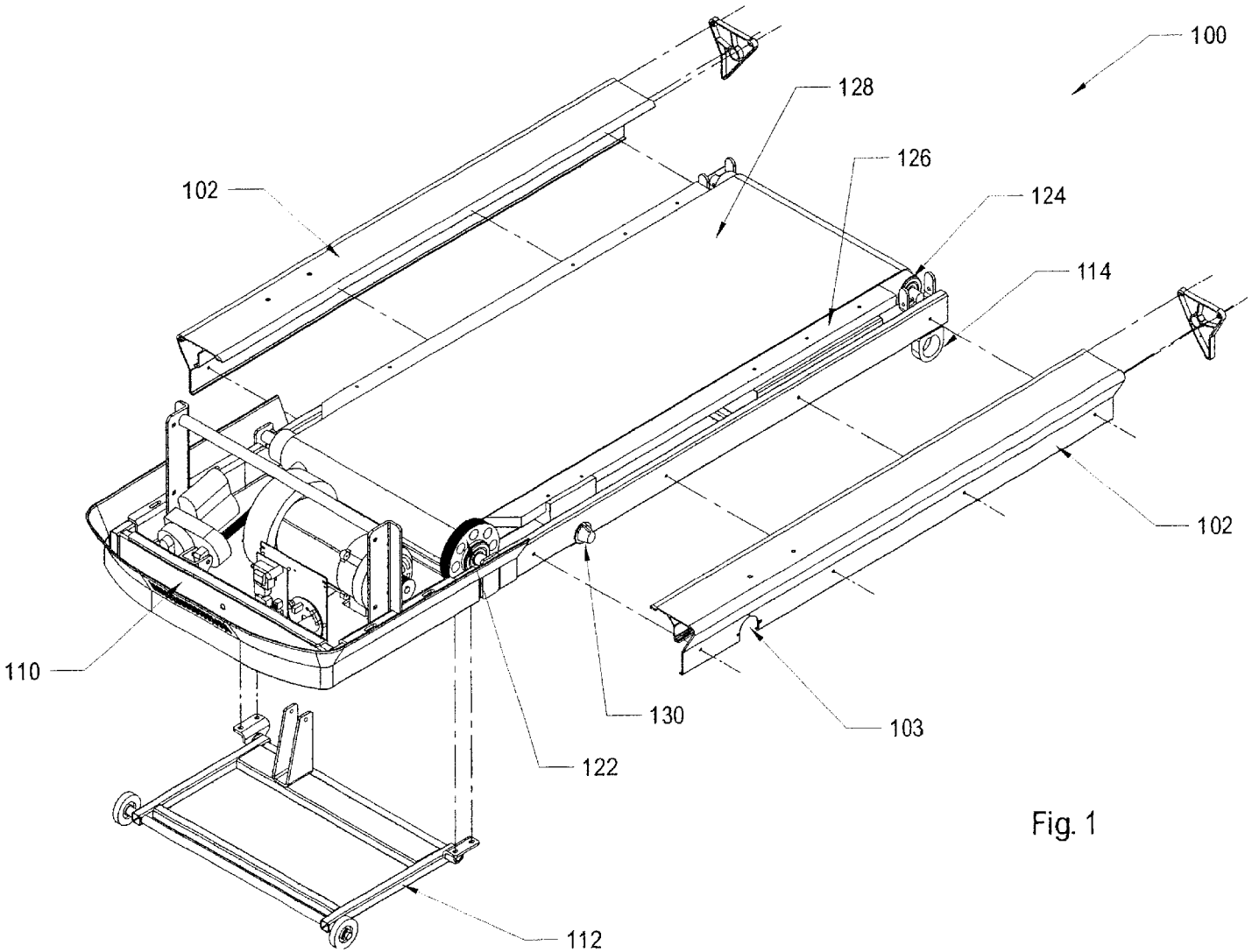
FIG. 1 is a partially exploded, perspective view of an exercise treadmill constructed according to the principles of the present invention.

A preferred embodiment treadmill constructed according to the principles of the present invention is designated as 100 in FIG. 1. Recognizing that the treadmill 100 is conventional in many respects, and that the invention is not limited to any particular type of exercise equipment, the following description focuses primarily on the energy absorbing aspect of the treadmill 100.

Generally speaking, the treadmill 100 includes a frame 110 that is supported relative to an underlying floor surface by means of a front elevation adjustment assembly 112 and rear legs 114. Front and rear rollers 122 and 124 are rotatably mounted on the frame 110, and a deck 126 is mounted on the frame 110 between the rollers 122 and 124. An endless belt 128 is disposed about the rollers 122 and 124 and the deck 126, and the upwardly facing portion of the belt 128 is supported by the deck 126.

Figure 2:
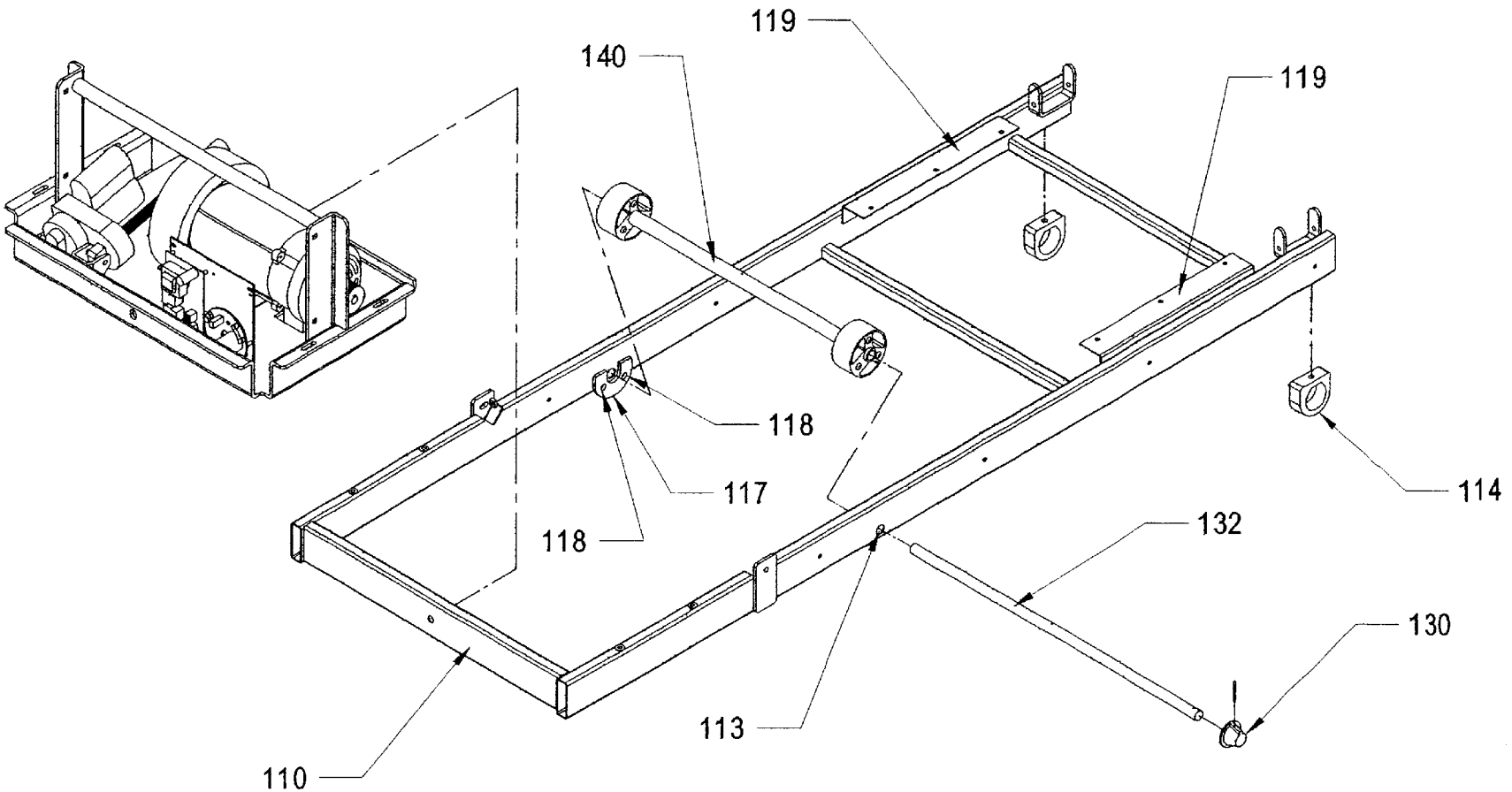
FIG. 2 is a partially exploded, perspective view of certain components on the treadmill of FIG. 1.

Some of the components of the treadmill 100 are shown more clearly in FIG. 2. Among other things, L-shaped brackets 119 are secured to the rear portion of the frame 110 to support a rearward portion of the deck 126. An energy absorbing assembly 140 is mounted on an intermediate portion of the frame 110 to support a forward portion of the deck 126.

Figure 3:
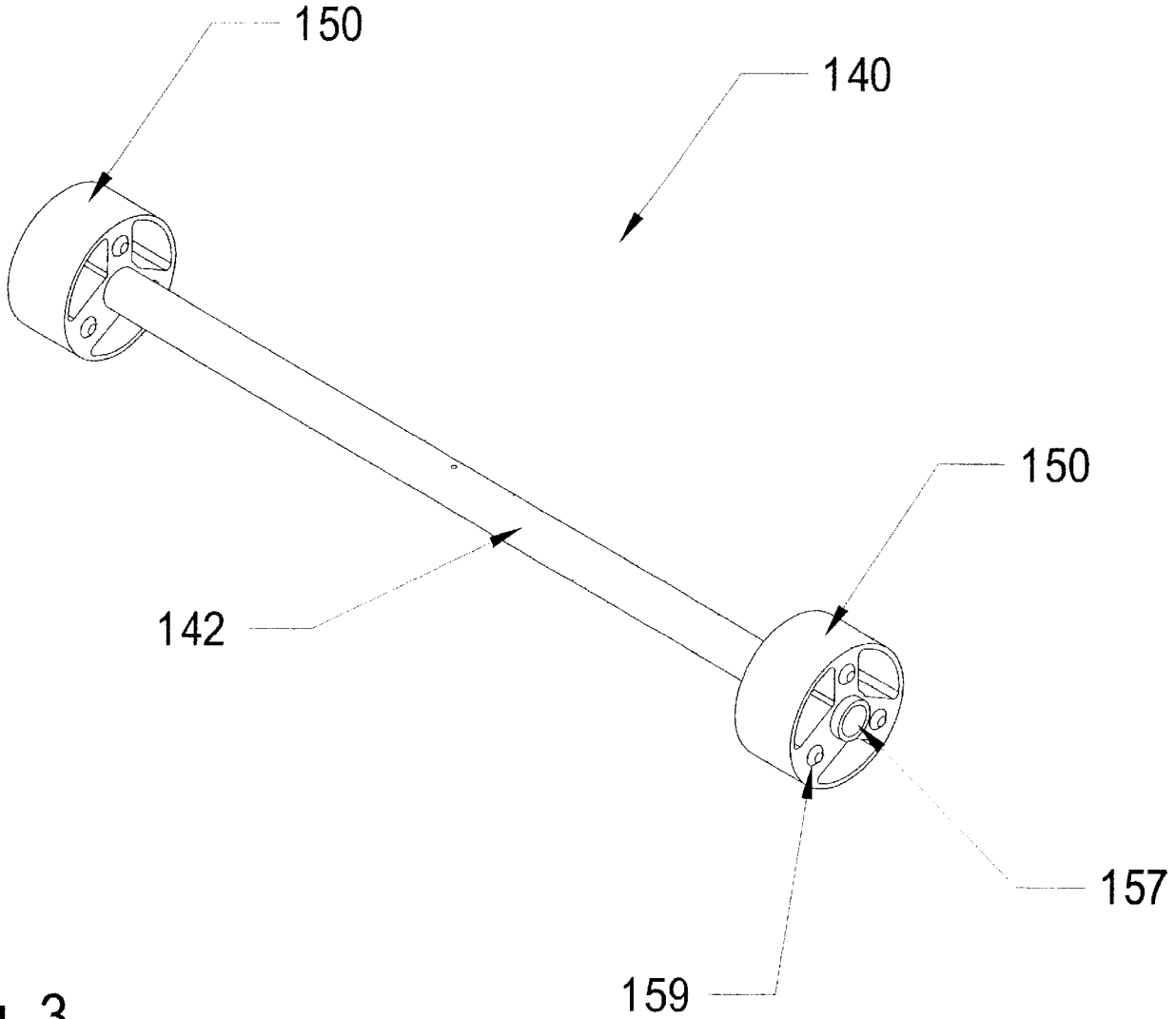
FIG. 3 is a perspective view of an energy absorbing assembly on the treadmill of FIG. 1.

With reference to FIG. 3, the energy absorbing assembly 140 includes opposite side energy absorbers 150 interconnected by a shaft 142. The assembly 140 is disposed between opposite sides of the frame 110 and secured in place by a rod 132 extending through aligned holes 113 is the sides of the frame 110. A knob 130 is keyed to one end of the rod 132, which in turn, is keyed to the shaft 142. The resulting assembly is selectively rotatable relative to the frame 110. As shown in FIG. 1, the knob 130 is accessible to a user via an opening 103 in one of the side rails 102 on the frame 110.

Figure 4:
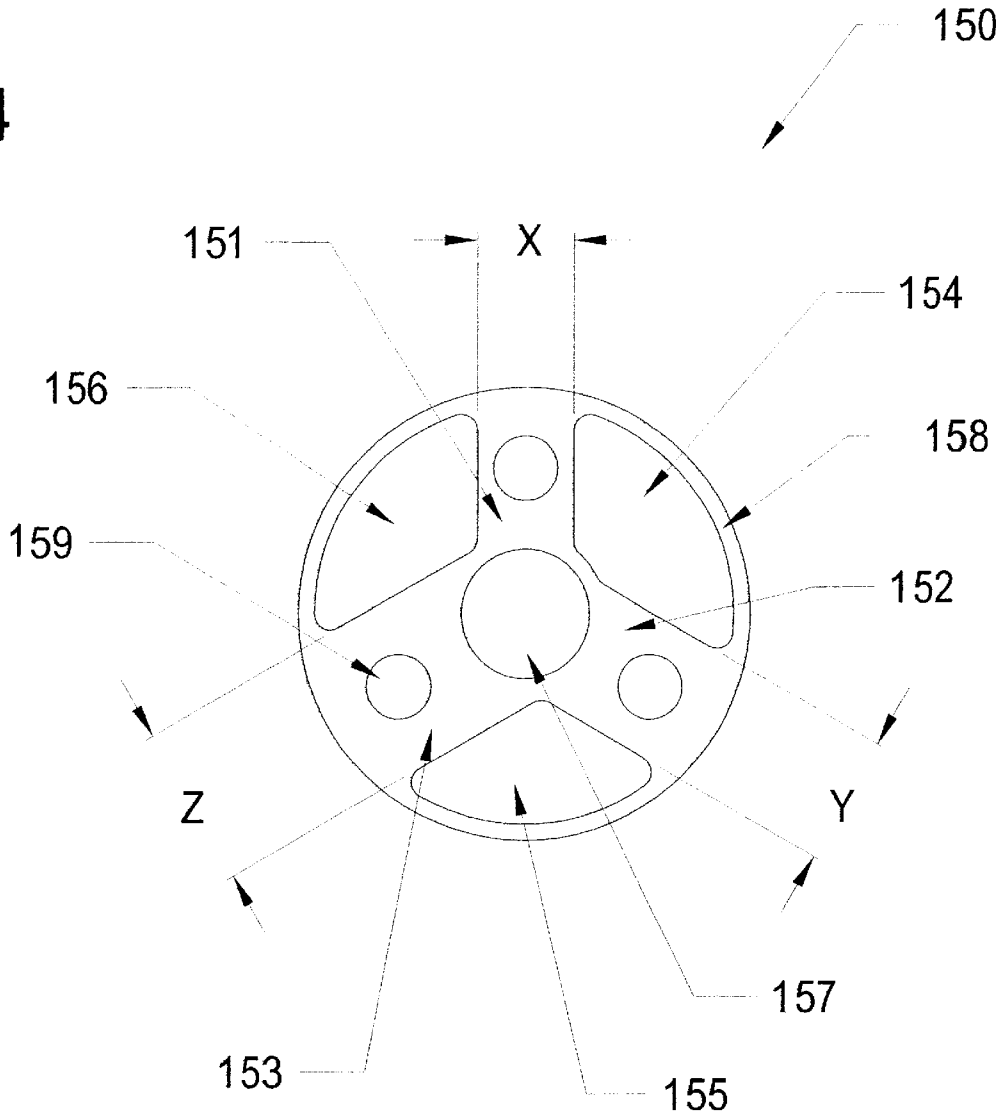
FIG. 4 is a side view of an energy absorbing member on the assembly of FIG. 3.

One of the two energy absorbing members 150 is shown by itself in FIG. 4. Each of the energy absorbing members 150 may be described as a cylindrical member having radially extending spokes 151–153 and/or axially extending openings 154–156. In other words, the spokes 151–153 may be described as defining openings 154–156 therebetween, and the openings 154–156 may be described as defining spokes 151–153 therebetween. In either case, the spokes 151–153 converge at a central hub disposed about an axially extending hole 157 having an inside diameter of approximately one inch. Opposite, distant ends of the spokes 151–153 are interconnected by a circumferential rim 158 having an outside diameter of approximately three and one-half inches. A nub 159 projects outward from each of the spokes 151–153 for reasons explained below. Each of the nubs 159 is disposed an equal radial distance from the center of the energy absorbing member 150, and the nubs 159 are circumferentially spaced 120° apart from one another.

Each of the energy absorbing members 150 is made of an elastomeric material, such as synthetic or natural rubber. For example, it is believed that a 50 durometer, A shore, silicon rubber provides desirable results. The members 150 are preferably integrally formed and vulcanized to the shaft 142.

The spoke 151 has a thickness X of approximately three-quarters of one inch, as measured perpendicular to a first radius emanating from the cylindrical axis of the member 150 and bisecting the spoke 151. The spoke 152 has a thickness Y of approximately one inch, as measured perpendicular to a second radius emanating from the cylindrical axis of the member 150 and bisecting the spoke 152. The spoke 153 has a thickness Z of approximately one and one-quarter inches, as measured perpendicular to a third radius emanating from the cylindrical axis of the member 150 and bisecting the spoke 153.

As a result of the different spoke thicknesses, the energy absorption of the members 150 is a function of the members' orientation relative to the deck 126. For example, when the members 150 are oriented as shown in FIG. 4 (with the relatively thin spokes 151 disposed directly between the deck 126 and the shaft 142), the assembly 140 is relatively more sensitive, but has less capacity to absorb energy during exercise. If the assembly 140 is rotated so that relatively larger spokes 152 or 153 are disposed directly between the deck 126 and the shaft 142, then the assembly 140 is relatively less sensitive, but has more capacity to absorb energy during exercise. As a result, the assembly 140 may be rotated to accommodate people of different sizes and/or people with different exercise needs. In this regard, the "X" setting is better suited for a relatively light person who wishes to walk on the treadmill, whereas the "Z" setting is better suited for a heavy person who wishes to run on the treadmill.

Semi-circular brackets 117 are mounted on opposite sides of the frame 110 and surround the lower half of each of the holes 113. The brackets 117 have openings 118 which are sized and configured to receive aligned nubs 159 on the energy absorbing members 150. The openings 118 cooperate with the nubs 159 to provide a detent system which encourages the members 150 to remain in one of three orientations relative to the frame 110. In other words, a user must turn the knob 130 with force sufficient to overcome the bias of the detent system, in order to adjust the energy absorbing characteristic of the treadmill 100.

Those skilled in the art will recognize that it may be desirable to provide low friction coatings on the outside of the members 150 and/or the underside of the deck 126, in order to facilitate rotation of the former relative to the latter. Another way to facilitate relative rotation is to dispose one or more idler rollers between the deck 126 and each of the members 250.

The present invention also may be described in terms of a method of absorbing energy associated with exercise movement. In one such method, a variable amount of energy absorbing material is disposed between a treadmill deck and a treadmill frame. On the treadmill 100, for example, the energy absorbing members 150 are selectively rotated relative to the frame 110 to adjust capacity and/or sensitivity of the energy absorbing assembly 140.

Figure 5:
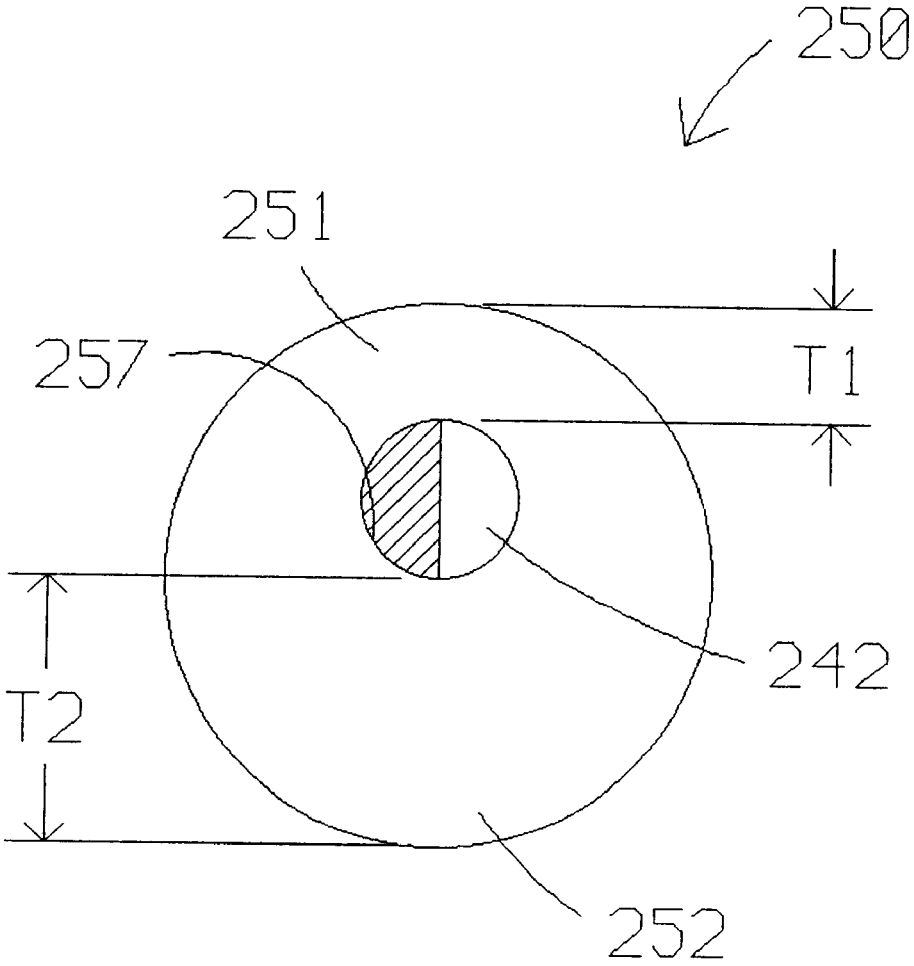
FIG. 5 is a side view of an alternative embodiment energy absorbing member suitable for use on the assembly of FIG. 3.

Those skilled in the art will also recognize that the present invention may be modified and/or applied in a variety of ways. For example, an energy absorbing member having an alternative configuration is designated as 250 in FIG. 5. The member 250 may be described as a cylinder having an offset bore 257 sized and configured to receive a shaft 242. In a first orientation relative to a treadmill frame, a relatively small amount of energy absorbing material 251, having a thickness T1, is disposed between the shaft 242 and an overlying treadmill deck. In a second orientation relative to the frame, a relatively large amount of energy absorbing material 252, having a thickness T2, is disposed between the shaft 242 and the deck. In order to compensate for the variable thickness of energy absorbing material, an eccentric idler roller may be provided between the member 250 and the deck, and/or the deck may be arranged to pivot upward enough to accommodate the difference in the thicknesses T1 and T2.

Figure 6:
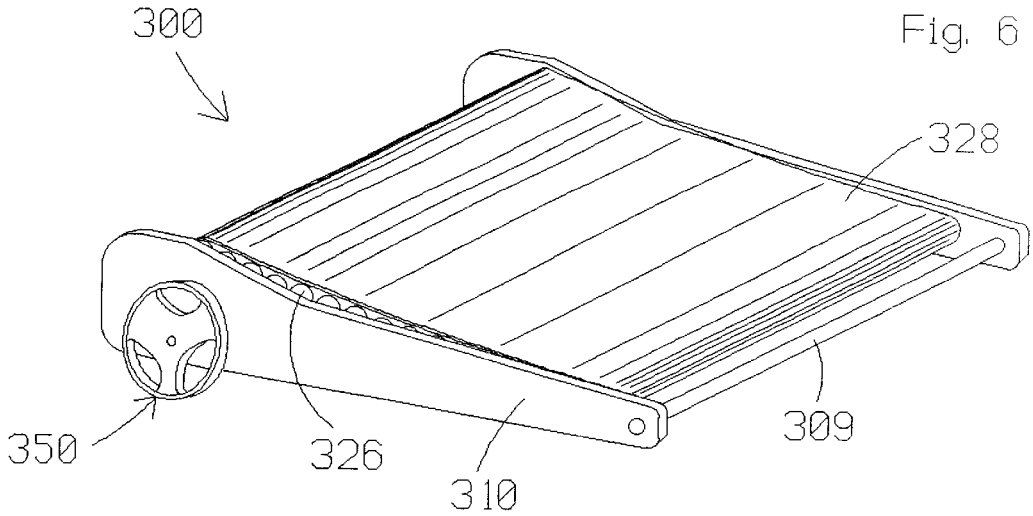
FIG. 6 is a perspective view of another treadmill constructed according to the principles of the present invention.
Figure 8:
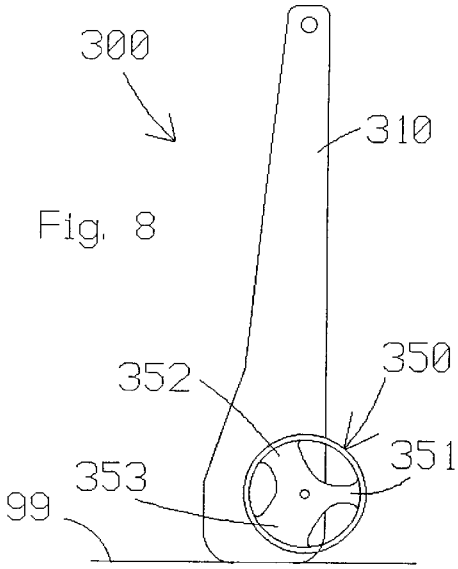
FIG. 8 is a side view of the treadmill of FIG. 6 in a storage orientation relative to an underlying floor surface.
Figure 7:
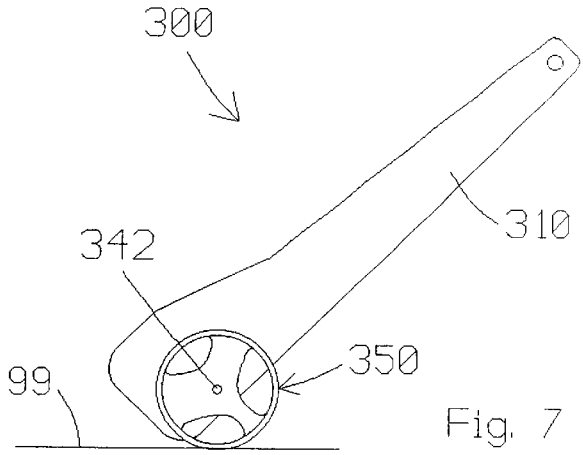
FIG. 7 is a side view of the treadmill of FIG. 6 in a mobilized orientation relative to an underlying floor surface.

An alternative embodiment treadmill 300 with left and right energy absorbing members 350 is shown in FIGS. 6–8. With the exception of the energy absorbing members 350, the treadmill 300 is similar to the treadmill disclosed in U.S. Pat. No. 3,642,279 to Cutter, which is incorporated herein by reference. On this embodiment 300, an endless tread 328 is disposed about a deck comprised of a plurality of adjacent rollers 326. The energy absorbing members 350 are mounted on opposite ends of an axle 342 and protrude downward into contact with a floor surface 99. In this context, each of the members 350 may be described as a wheel, as well as an energy absorber. Thus, the members 350 provide both a means for absorbing energy associated with exercise, and a means for moving the treadmill 300 across an underlying floor surface 99.

The wheels 350 are relatively larger than the energy absorbing members 150, in part because they are supporting more mass, and in part to facilitate travel across a floor surface. As illustrated in FIGS. 6–8, the wheels 350 are positioned relative to the frame 310 in such a manner that they engage the floor surface 99 except when the frame 310 is positioned in a vertical storage orientation, resting on the forward end of the frame 310. A handle 309 is provided on the rear end of the frame 310 to facilitate movement of the treadmill 300 into and out of the storage orientation.

Like the energy absorbing members 150 described with reference to the first embodiment 100, the wheels 350 have three spokes 351–353 of different widths. When the wheels 350 are oriented as shown in FIG. 6, the thinnest spoke 351 is disposed between the shaft 342 and the floor surface, and the system has greater sensitivity and less capacity, as compared to when another of the spokes 352–353 is disposed between the shaft 342 and the floor surface.

Those skilled in the art will recognize the desirability of selectively locking the wheels 350 against rotation relative to the frame 310. One of many possible locking mechanisms is designated as 369 in FIGS. 9*a*–9*b*. The mechanism 369 includes a bar 370 which is movable axially relative to the frame 310. The bar 370 includes an engaging portion 372 and an offset portion 373. The bar 370 is aligned with a machined section of the wheel shaft 342. In particular, three flat surfaces 346 have been cut into the otherwise cylindrical outer surface 344 of the shaft 342. Adjacent surfaces 346 define an angle of 1200 therebetween.

When the bar 370 is in its locked position (FIG. 9*a*), the engaging portion 372 closely parallels one of the surfaces 346 and thereby prevents rotation of the shaft 342. When the bar 370 is moved to its unlocked position (FIG. 9*b*), the offset portion 373 displaces the engaging portion 372 relative to the shaft 342, thereby freeing the shaft 342 for rotation. A helical coil spring 380 is disposed in compression between the frame 310 and a shoulder 378 on the bar 370. The spring 380 biases the bar 370 toward its locked position and resists movement of the bar 370 into its unlocked position.

The engaging portion 372 of the bar 370 extends rearward to a distal end 376 which is accessible to a user. A pulling force exerted on the end 376 frees the wheels 350 for rotation relative to the frame 310. This arrangement allows a person grabbing the bar 309 to operate the locking mechanism 369, as well (and the two components 309 and 369 may even be interconnected, if desired) The offset portion 373 of the bar 370 extends forward to a distal end 374 which also may be made accessible to a user. A pushing force exerted on the end 374 would similarly free the wheels 350 for rotation relative to the frame 310. This arrangement would allow a person to adjust the wheels 350 relative to the frame 310 without moving the treadmill 300 across the floor surface.

As suggested by the foregoing description, the present invention may be generally described as an exercise treadmill, comprising a base designed to rest upon a floor surface; a deck mounted on the base; an endless tread disposed about the deck; a variable amount of resilient material disposed in series between the deck and the floor surface to absorb energy resulting from a person shifting body weight onto the deck; and an adjusting means, connected to the resilient material and accessible to a user, for selectively adjusting how much of the resilient material is disposed in series between the deck and the floor surface. The treadmill may further comprise a biasing means, connected to the adjusting means, for biasing a desired amount of the resilient material to remain in series between the deck and the floor surface.

The resilient material may include first and second resilient members mounted on respective sides of the base for selective rotation relative to the base, and/or for supporting the base relative to the floor surface. Each resilient member may be bounded by a cylindrical surface disposed about a longitudinal axis, and each resilient member may have an asymmetrical profile disposed about the axis. Also, the adjusting means may include a shaft which supports the resilient members and which is rotatably mounted on the base. Furthermore, the biasing means may include nubs which interfere with rotation of the resilient members, and/or a bar which interferes with rotation of the shaft.

Another energy absorbing assembly constructed according to the principles of the present invention is designated as 400 in FIGS. 10*a*–10*e*. The assembly 400 generally includes left and right strips of resilient material mounted on a frame 410 and comprised of three discrete materials 415–417, and a roller assembly 450 disposed between the strips and a treadmill deck. At least one end of the treadmill deck is anchored to the frame 410.

The roller assembly 450 includes first and second shafts 452 which extend parallel to one another and protrude beyond opposite sides of the treadmill deck. The ends of the shafts 452 extend through notches or gaps 425 in brackets 420 that are mounted on respective sides of the deck 420. Rigid, cylindrical rollers 454 are rotatably mounted on the ends of the shafts 452 and disposed inside the brackets 420. In this manner, a downwardly extending sector of each roller 454 is effectively sandwiched between a respective bracket 420 and a respective strip of resilient material. As suggested by FIGS. 10*a*–10*e,* the roller assembly 450 is selectively movable along the strip of resilient material, and various means may be provided for moving and/or preventing undesired movement of the roller assembly 450 relative to the strip of resilient material.

Figures 10A, 10B, 10C, 10D, 10E:
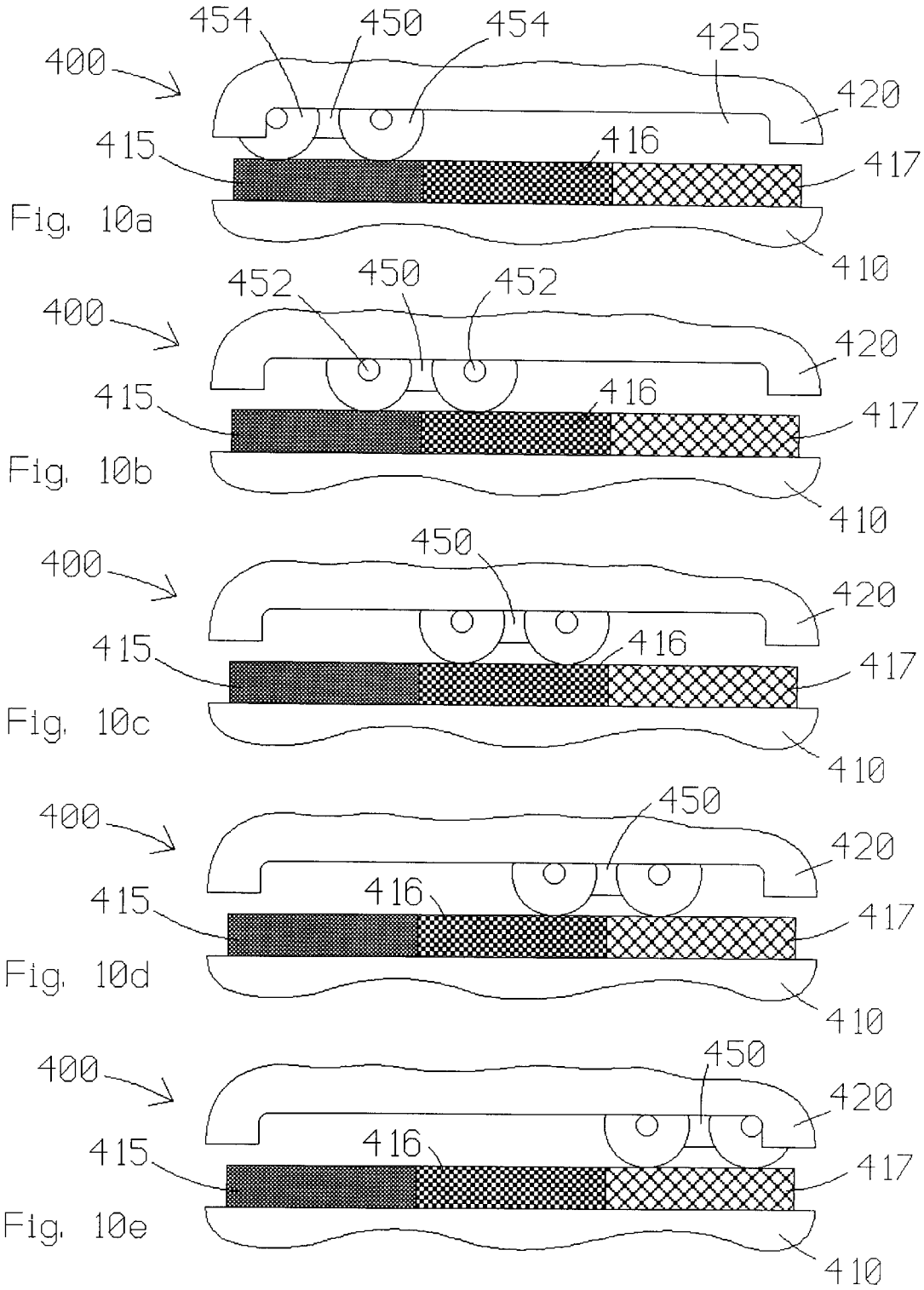
FIGS. 10*a*–10*e* are side views of another adjustable energy absorbing assembly constructed according to the principles of the present invention.

When the roller assembly 450 occupies the position shown in FIG. 10*a,* both rollers 454 rest on top of the first material 415, and the arrangement is set for maximum capacity and/or minimum sensitivity. When the roller assembly is moved to the position shown in FIG. 10*b,* one roller 454 remains on top of the first material 415, and the other roller 454 comes to rest on top of the second, relatively more flexible material 416. When the roller assembly 450 is then moved to the position shown in FIG. 10*c,* both rollers 454 come to rest on top of the second material 416. When the roller assembly 450 is then moved to the position shown in FIG. 10*d,* one roller remains on top of the second material 416, and the other roller 454 comes to rest on top of the third, still more flexible material 417. Finally, when the roller assembly 150 is then moved to the position shown in FIG. 10*e,* both rollers comes to rest on top of the third material 417, and the arrangement is set for minimum capacity and/or maximum sensitivity.

Figure 11:
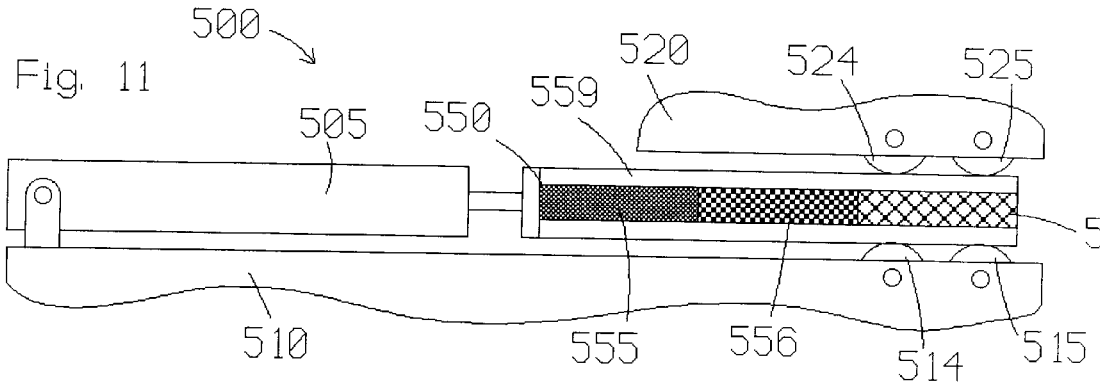
FIG. 11 is a side view of yet another adjustable energy absorbing assembly constructed according to the principles of the present invention.

Another energy absorbing assembly constructed according to the principles of the present invention is designated as 500 in FIG. 11. The assembly 500 generally includes left and right planks 550 comprised of three discrete resilient materials 555–557 and sandwiched between respective rollers 514 and 515 rotatably mounted on a frame 510 and respective rollers 524 and 525 rotatably mounted on a treadmill deck (via respective brackets 520). At least one end of the treadmill deck is anchored to the frame 510. The rollers 514–515 and 524–525 are preferably cylindrical in shape and more rigid than the least flexible material 555.

The planks 550 are selectively movable relative to the rollers 514–515 and 524–525 to provide five levels of energy absorption which are comparable to those discussed above with reference to FIGS. 10*a*–10*e*. For example, an end of the plank 550 is secured to a distal rod end of a linear actuator 505. Those skilled in the art will recognize that a separate actuator 505 may be provided on each side of a treadmill, or a single actuator 505 may be connected to both planks 550 via a common bracket. Those skilled in the art will also recognize that a similar actuator arrangement may be used in connection with the roller assembly 450 on the previous embodiment 400.

When the rod end of the actuator 505 is retracted, as shown in FIG. 11, the most flexible material 557 is sandwiched between the rollers 514–515 and 524–525, and the arrangement is set for minimum capacity and/or maximum sensitivity. When the rod end is extended, the least flexible material 555 will be sandwiched between the rollers 514–515 and 524–525, and the arrangement will be set for maximum capacity and/or minimum sensitivity. As with the previous embodiment 400, there are three intermediate settings between these two extremes. The three different materials 555–557 are preferably disposed inside a flexible cover or sheath 559 for purposes of maintaining structural integrity and smooth transitions between energy absorption levels.

Figure 12:
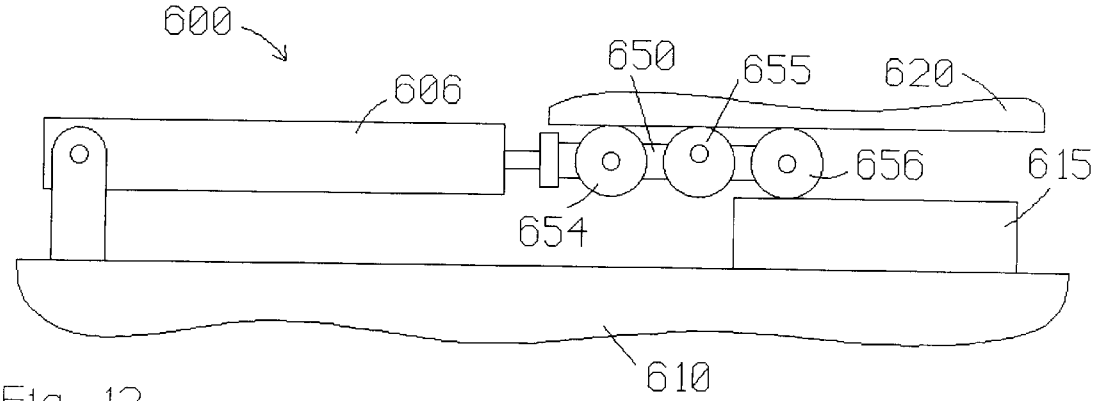
FIG. 12 is a side view of still another adjustable energy absorbing assembly constructed according to the principles of the present invention.

Another energy absorbing assembly constructed according to the principles of the present invention is designated as 600 in FIG. 12. The assembly 600 generally includes a roller assembly 650 sandwiched between a treadmill deck 620 and left and right blocks of resilient material 615 mounted on a frame 610. At least one end of the treadmill deck is anchored to the frame 610. The roller assembly 650 includes left and right rollers 654–656 that are preferably cylindrical in shape and more rigid than the blocks of resilient material 615.

As with the previous embodiment 500, an end of the roller assembly 650 is secured to a distal rod end of a linear actuator 606. In this case, a single actuator 606 is connected to a U-shaped bar on which all of the rollers 654–656 are rotatably mounted. When the rod end of the actuator 606 is retracted, as shown in FIG. 12, only the lead roller 656 is sandwiched between the treadmill deck 620 and frame 610, and the arrangement is set for minimum capacity and/or maximum sensitivity. When the rod end is extended, all three rollers 654–656 will sandwiched between the treadmill deck 620 and frame 610, and the arrangement will be set for maximum capacity and/or minimum sensitivity. The rollers 654–656 and the underside of the deck 620 are preferably designed to minimize frictional resistance to rotation of the former relative to the latter. Alternatively, idler rollers may be disposed between the rollers 654–656 and the deck 620, or the assembly 600 may be modified to accommodate a slot and shaft arrangement like that described with reference to FIGS. 10*a*–10*e*. In this regard, it is to be understood that features described with reference to different embodiments may be applicable to other embodiments and/or mixed and matched in various ways.

Figure 13:
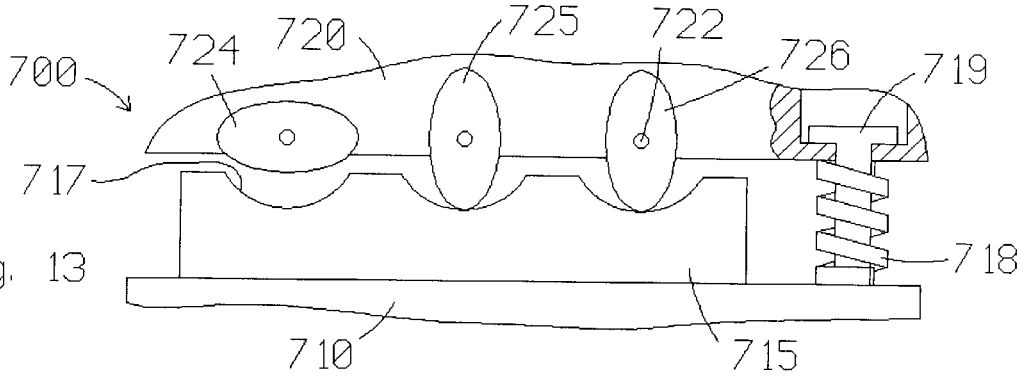
FIG. 13 is a side view of one more adjustable energy absorbing assembly constructed according to the principles of the present invention.

Another energy absorbing assembly constructed according to the principles of the present invention is designated as 700 in FIG. 13. The assembly 700 generally includes a variable number of support members 724–726 sandwiched between a treadmill deck 720 and respective blocks of resilient material 715 mounted on a frame 710. At least one end of the deck 720 is anchored to the frame 710.

The support members 724–726 are preferably more rigid than the blocks of resilient material 715, and they are rotatably mounted on opposite sides of the deck 720 (or on brackets secured to opposite sides of the deck 720). More specifically, pairs of first and second support members 724, 725, or 726 are rigidly mounted on opposite ends of a respective shaft 722 which, in turn, is rotatably mounted on the treadmill deck 720. Each individual support member 724, 725, and 726 is eccentrically shaped relative to its axis of rotation, and may be described as having an elliptical perimeter.

The blocks 715 are rigidly mounted on opposite sides of the frame 710, with arcuate notches 717 in the blocks 715 aligned with respective support members 724–726. At least one resilient post or spring 718 is provided on at least one block 715 or elsewhere between the deck 720 and the frame 710 to support some of the load. Similar arrangements may be added to the other embodiments, as well. In this case, the spring 718 is compressed between the deck 720 and the frame, and a stop 719 is secured to the frame 710 to limit upward travel of the deck 720 relative to the frame 710.

In the absence of user weight acting upon the deck 720, the support members 724–726 are rotatable between disengaged orientations (see support member 724) and engaged orientations (see support members 725–726). More engaged support members 724–726 translates into greater capacity and less sensitivity. Various latching arrangements, including spring detents, may be used to prevent undesired rotation of the support members 724–726.

Among other things, the present invention also may be generally described in terms of a base designed to rest upon a floor surface; a user support mounted on the base; and a means for disposing a variable amount of energy absorbing material in series between the user support and the floor surface. Similarly, the present invention may be generally described in terms of a method wherein a base is provided to rest upon a floor surface; a user support is mounted on the base; and a user is allowed to adjust how much energy absorbing material is disposed in series between the user support and the floor surface.

The present invention has been described with reference to specific embodiments and particular applications. Recognizing that persons skilled in the art are likely to recognize additional embodiments, variations, and/or applications as a result of this disclosure, the scope of the present invention should be construed to include same, and in any event, should be limited only to the extent of the following claims.

What is claimed is:

1. An exercise treadmill, comprising:

a base designed to rest upon a floor surface;

a deck mounted on the base;

an endless tread disposed about the deck; and a means for disposing a variable amount of energy absorbing material in series between the deck and the floor surface, wherein the energy absorbing material is a strip of resilient material, and the means includes at least one roller rotatably mounted on the deck and resting on top of the strip.

2. The treadmill of claim 1, wherein the at least one roller is selectively movable along the strip.

3. The treadmill of claim 1, wherein the strip has first and second portions with different resiliency characteristics.

4. The treadmill of claim 1, wherein the means further includes another roller rotatably mounted on the deck and selectively resting on top of the strip.

5. The treadmill of claim 4, wherein the another roller is selectively movable linearly relative to the strip.

6. The treadmill of claim 4, wherein the another roller is selectively rotatable between distinct orientations relative to the strip.

7. A method of absorbing energy associated with exercise on a treadmill, comprising the steps of:

providing a base designed to rest upon a floor surface;

mounting a deck on the base;

disposing an endless tread about the deck;

providing an energy absorbing material, wherein the energy absorbing material is provided as a strip of resilient material on the base; and allowing a user to adjust how much of the energy absorbing material is disposed in series between the deck and the floor surface, wherein the user is allowed to adjust at least one point of contact between the deck and the strip.

8. A method of absorbing energy associated with exercise on a treadmill, comprising the steps of:

providing a base designed to rest upon a floor surface;

mounting a deck on the base;

disposing an endless tread about the deck;

providing an energy absorbing material, wherein the energy absorbing material is provided as a strip of resilient material on the base;

rotatably mounting a roller on the deck; and allowing a user to adjust how much of the energy absorbing material is disposed in series between the deck and the floor surface, wherein the user is allowed to selectively move the roller along the strip.

* * * * *